US012324548B2

(12) United States Patent
Zenone

(10) Patent No.: US 12,324,548 B2
(45) Date of Patent: Jun. 10, 2025

(54) SOAP HOLDER

(71) Applicant: Maria Teresa Zenone, Cavagliano Frazione Bellinzago (IT)

(72) Inventor: Maria Teresa Zenone, Cavagliano Frazione Bellinzago (IT)

( * ) Notice: Subject to any disclaimer, the term of this patent is extended or adjusted under 35 U.S.C. 154(b) by 0 days.

(21) Appl. No.: 18/494,511

(22) Filed: Oct. 25, 2023

(65) Prior Publication Data

US 2025/0134321 A1 May 1, 2025

(51) Int. Cl.
*A47K 5/05* (2006.01)

(52) U.S. Cl.
CPC ..... *A47K 5/05* (2013.01)

(58) Field of Classification Search
CPC ..... A47K 5/05
See application file for complete search history.

(56) References Cited

U.S. PATENT DOCUMENTS 2,320,608 A * 6/1943 Jones ..... A47K 5/05 248/205.5
2,679,709 A * 6/1954 Du Bois ..... A47K 5/05 248/579
3,289,990 A * 12/1966 Grantham ..... A47K 1/09 248/908
3,552,705 A * 1/1971 Caster ..... A47K 5/05 248/309.4
5,368,268 A * 11/1994 Jodwischat ..... A47K 5/05 248/309.4
5,642,871 A * 7/1997 Repert ..... A47K 5/05 248/309.4
D477,949 S 8/2003 Cascio et al.
2019/0380512 A1* 12/2019 Murawczyk ..... A47F 7/28

FOREIGN PATENT DOCUMENTS

CH 174319 A 1/1935
CH 317014 A 10/1956
CN 2047171 U 11/1989
CN 2061028 U 8/1990
(Continued)

OTHER PUBLICATIONS

Extended European Search Report for EP Application No. 22170197.2 dated Sep. 23, 2022, 7 pages.

*Primary Examiner* — Anita M King
(74) *Attorney, Agent, or Firm* — NIXON & VANDERHYE

(57) ABSTRACT

A soap holder for supporting a soap bar having a through-hole includes at least one elongate body having a prevailing extension direction and being capable of being inserted within the through-hole, an attachment system connected to the elongate body and configured to constrain the elongate body to a support member with the prevailing extension direction parallel to the vertical direction, a holding element configured to support the soap bar preventing the soap bar from sliding away from the elongate body when the elongate body is inserted inside the through-hole, a connection system including permanent magnets, for releasably constraining the elongate body to the holding element and for allowing the soap holder to be arranged in two configurations, in which the holding element obstructs the dropping of the soap bar, and in which the holding element does not obstruct the insertion of the elongate body within the through-hole.

7 Claims, 4 Drawing Sheets

(56) References Cited

FOREIGN PATENT DOCUMENTS

| | | | | | |
|---|---|---|---|---|---|
| CN | 2267750 | Y | | 11/1997 | |
| CN | 2482374 | Y | | 3/2002 | |
| DE | 19963449 | A1 | | 8/2000 | |
| DE | 19958433 | A1 | | 6/2001 | |
| FR | 387743 | A | | 7/1908 | |
| FR | 588556 | A | | 5/1925 | |
| FR | 599967 | A | | 1/1926 | |
| FR | 754825 | A | | 11/1933 | |
| FR | 2650168 | A1 | * | 2/1991 | |
| GB | 2384181 | A | * | 7/2003 | ..... A47K 5/05 |
| IT | TO20111252 | A1 | | 3/2012 | |
| JP | S569294 | A | | 1/1981 | |
| WO | 2013098865 | A1 | | 7/2013 | |

* cited by examiner

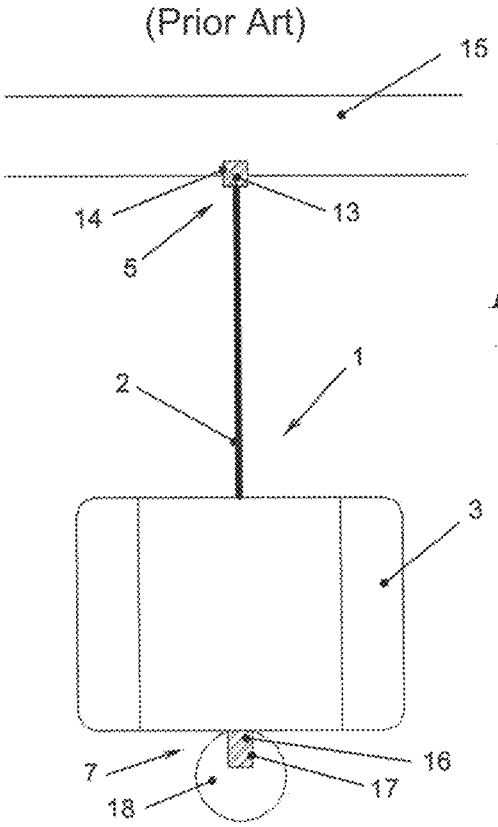
Fig. 5
Fig. 6
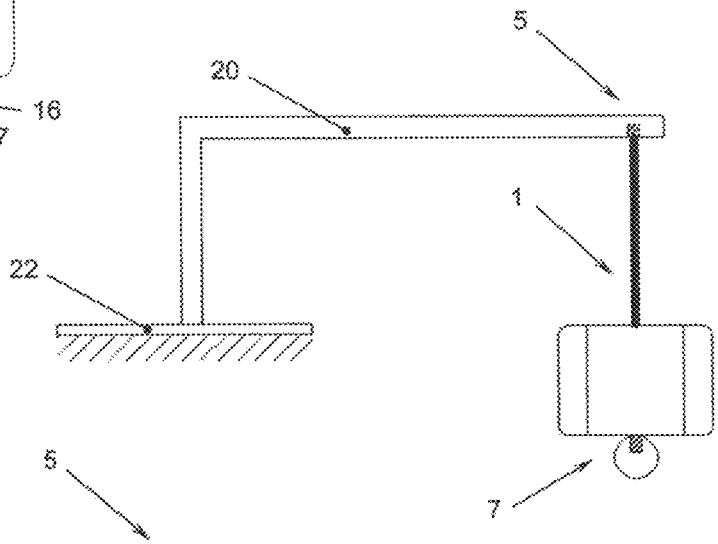
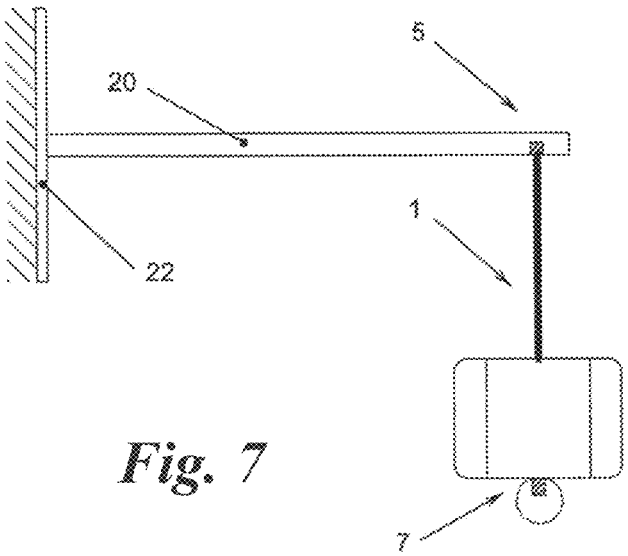
Fig. 7

SOAP HOLDER

FIELD OF THE INVENTION

The present invention relates to a soap holder capable of supporting a soap bar, the soap bar comprising a through-hole, the soap holder comprising: at least one elongate body having a prevailing extension direction and being capable of being inserted within the through-hole; attachment means connected to the elongate body and configured to constrain the elongate body to a support element having the prevailing extension direction parallel to the vertical direction; a holding element capable of supporting the soap bar preventing the soap bar from sliding away from the elongate body when the elongate body is inserted inside the through-hole; connection means capable of releasably constraining the elongate body to the holding element and allowing the soap holder to be arranged: in a constraining configuration, in which the holding element prevents the soap holder from falling, and in a replacement configuration, in which the holding element does not obstruct the insertion of the elongated body within the through-hole.

In particular, it is suitable for being made in a variety of configurations, being adaptable to any type of washbasin or washbasin, bathtub or shower, both for indoor and outdoor use, and being suitable for working with any type of soap holder, in particular if shaped as described below.

DESCRIPTION OF THE PRIOR ART

Traditional soap holders are known in the technique, made in the form of containers of various configurations, placed above washbasins, washbasins and sanitary fixtures in general, and capable of holding at least one soap bar inside: In addition to the various limitations of such soap holders related to their conformation and location, over time the used soap contained in them, in the presence of residual water, progressively dissolves and soils the walls of the soap holder and the surrounding environment, requiring various cleaning interventions and reducing the useful life of the soap holder itself.

In order to solve these problems, prior art has provided for certain types of "hanging" soap holders, as described for example in DE-A1-19963449, CN-Y-2482374, CN-Y-2267750, CN-U-2061028, CN-U-2047171, DE-A1-19958433 and US-S1-D477949, which, however, have the drawback of being magnetic and therefore guaranteeing a poor hold of the soap holder, which often falls into the basin. In addition, the soap bar must be fitted with a magnetic plate to be attracted, inserted manually by force into it, with obvious problems of precision of placement and inconvenience of installation for the user, not to mention the fact that, with use, when the soap bar itself gradually wears out, the plate embedded in it tends to detach.

The documents CH-A-317 014, FR-A-387 743, CH-A-174319, FR-A-754 825, FR-A-599 967 and FR-A-588 556 describe soap holders according to the preamble to claim 1: none of them, however, provides for a soap holder capable of connecting to a tap by means of a rubber ring through which the soap holder cable passes.

The purpose of the present invention is to solve the aforementioned problems of the prior art, by providing a soap holder suitable to be made in a variety of configurations, to be adaptable to any type of sink or washbasin, bathtub or shower, whether for indoor or outdoor use, and to be capable of functioning with any type of soap holder. A further purpose of the present invention is to provide a soap holder as set forth above that allows maximum use of the soap holder attached thereto, without problems of soiling of related sinks and without inconvenience of placing and maintaining, within a soap holder, more or less reliable sealing equipment.

A further purpose of the present invention is to provide a soap holder that can also be used by persons with reduced manual dexterity, for example handicapped persons or children.

SUMMARY OF THE INVENTION

The aforementioned and other purposes and advantages of the invention, as will result from the following description, are achieved with a soap holder capable of supporting a soap bar, the soap bar comprising a through-hole, the soap holder comprising: at least one elongate body having a prevailing extension direction and being capable of being inserted within the through-hole; attachment means connected to the elongate body and configured to constrain the elongate body to a support element having the prevailing extension direction parallel to the vertical direction; a holding element capable of supporting the soap bar preventing the soap bar from sliding away from the elongate body when the elongate body is inserted inside the through-hole; connection means capable of releasably constraining the elongate body to the holding element and allowing the soap holder to be arranged: in a constraining configuration, in which the holding element prevents the soap holder from falling, and in a replacement configuration, in which the holding element does not obstruct the insertion of the elongated body within the through-hole; the elongate body being a rigid rod, the connecting means comprising permanent magnets.

BRIEF DESCRIPTION OF THE DRAWINGS

It is understood that all the appended claims form an integral part of the present description.

The present invention will be best described by certain preferred forms of embodiment, provided by way of example and not limitation, with reference to the attached drawings, in which:

FIG. 5 is a side view of an installation configuration of the soap holder of FIG. 3;

FIG. 6 is a side view of a first preferred embodiment of a support, for a plane, for the soap holder according to the present invention;

FIG. 7 is a side view of a second preferred embodiment of a support, for a wall, for the soap holder according to the present invention;

DESCRIPTION OF THE PREFERRED EMBODIMENTS

Figure 1:
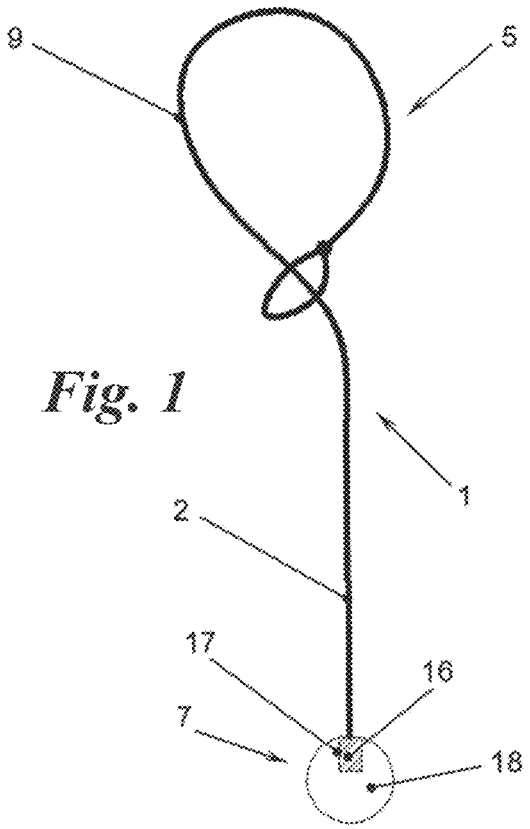
Fig. 1 (Prior Art)
FIG. 1 is a side view of a preferred first embodiment of the soap holder according to the prior art.

In the present document, the measurements, values, shapes and geometric references (such as perpendicularity and parallelism), when associated with words like "about" or other similar terms such as "approximately" or "substantially", are to be considered as except for measurement errors or inaccuracies due to production and/or manufacturing errors, and, above all, except for a slight divergence from the value, measurements, shape, or geometric reference with which it is associated. For instance, these terms, if associated with a value, preferably indicate a divergence of not more than 10% of the value.

Moreover, when used, terms such as "first", "second", "higher", "lower", "main" and "secondary" do not necessarily identify an order, a priority of relationship or a relative position, but can simply be used to clearly distinguish between their different components.

Unless otherwise specified, as results in the following discussions, terms such as "treatment", "computing", "determination", "calculation", or similar, refer to the action and/or processes of a computer or similar electronic calculation device that manipulates and/or transforms data represented as physical, such as electronic quantities of registers of a computer system and/or memories in, other data similarly represented as physical quantities within computer systems, registers or other storage, transmission or information displaying devices.

The measurements and data reported in this text are to be considered, unless otherwise indicated, as performed in the International Standard Atmosphere ICAO (ISO 2533:1975).

Referring to the Figures, a preferred form of realisation of the soap holder of the present invention is illustrated and described. It will be immediately obvious that innumerable variations and modifications (e.g., relating to shape, dimensions, arrangements and parts with equivalent functionality) can be made to the described embodiment without departing from the scope of protection of the invention as appears from the appended claims.

As illustrated in the Figures, the soap holder 1 of the present invention is suitable for supporting a soap bar 3, preferably by suspending it vertically, comprising a through-hole 3*a*. As soap bars usually have a shorter size than the others, the through-hole 3*a* preferably does not pass through the shorter size but one of the two larger sizes, preferably the larger size of the others, or alternatively the second larger size.

The soap holder 1 is preferably constrained to a support element 15, 20, hereinafter described. The soap holder 1 and the support element 15, 20 together form a soap holder apparatus 100.

The soap holder 1 found substantially comprises:

- at least one elongate body 2 having a prevailing extension direction 2*a* and being suitable for being inserted within the through-hole 3*a*,
- attachment means 5 connected to the elongate body 2 and configured to constrain the elongate body 2 to the support element 15, 20 with the prevailing extension direction 2*a* parallel to the vertical direction,
- a holding element 18, 18' capable of supporting said soap bar 3 preventing said soap bar 3 from sliding away from said elongate body 2 when said elongate body 2 is inserted inside said through-hole 3*a;*
- connection means 7 for releasably constraining said elongate body 2 to said holding element 18, 18' and allowing said soap holder 1 to be arranged
  - in a constraining configuration, wherein the holding element 18, 18' prevents the soap bar 3 from falling, and
  - in a replacement configuration, in which the holding element 18, 18' does not obstruct the insertion of the elongated body 2 within the through-hole 3*a*.

The connection means 7 preferably comprise, and more preferably are, permanent magnets.

As can be seen in the various Figures, the elongated body 2 may comprise a wire 2, made of steel, plastic or any other suitable material to ensure its flexibility. Moreover, the elongated body 2 could be constituted in other preferable ways, for example a small plastic tube or other flexible material (not illustrated), in various configurations suitable for the purpose, or again in rigid, non-flexible material (such as, for example, an asti-form metal rod: in this solution, a joint, placed in the upper part of the body, could allow the movement of the rod in the desired directions).

In practice, the support element 15, 20 may comprise a tap 15, as illustrated in FIG. 5, or a support 20 suitable to be placed on a plane (FIG. 6) or a wall (FIG. 7) for supporting the soap holder 1, if it is not considered useful to connect it directly to a tap 15. For this purpose, the support 20 may be provided, again as illustrated in FIGS. 6 and 7, with at least one contact element 22 (e.g. a suction cup, common screws, double-sided adhesive tape) enabling the support 20 to be attached precisely to a plane or a wall. Preferably, but not limitingly, as illustrated in FIG. 1, the attachment means 5 comprise a ring 9 made seamlessly with the cable 2, obtained by re-knotting the cable 2 on itself.

Figure 2:
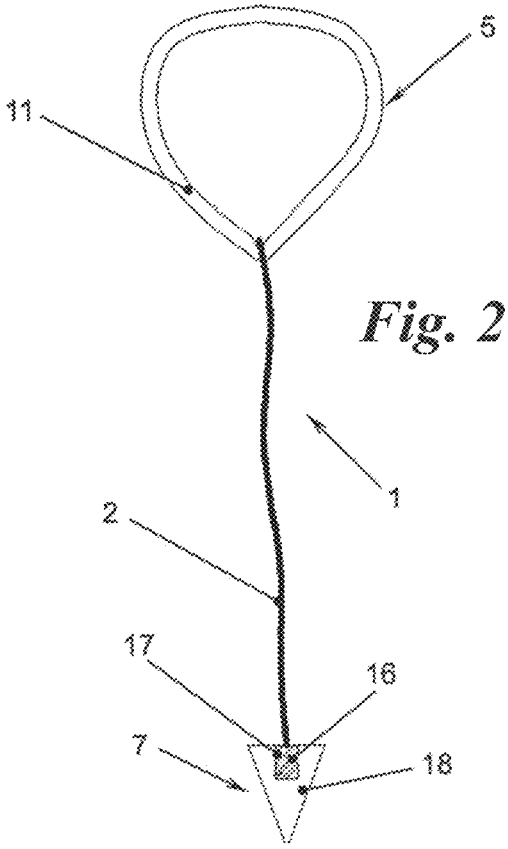
Fig. 2 (Prior Art)
FIG. 2 is a side view of a second preferred embodiment of the soap holder according to the prior art.

According to an alternative illustrated in FIG. 2, the coupling means 5 comprise a ring 11, preferably made of a plastic material, within which the cable 2 passes, or operatively connected to the cable 2.

Figure 3:
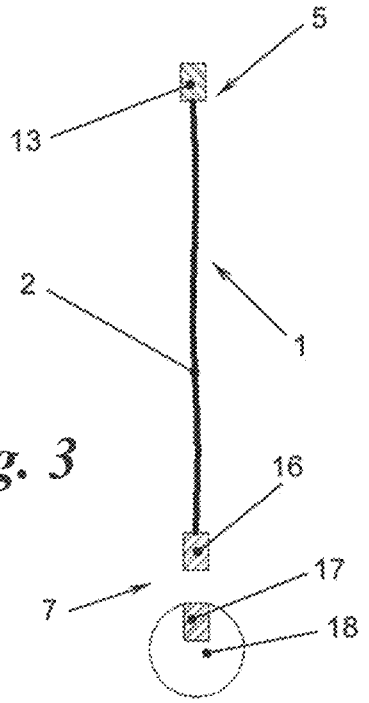
Fig. 3 (Prior Art)
FIG. 3 is a side view of a third preferred embodiment of the soap holder according to the prior art.

According to a further preferred alternative, illustrated in FIG. 3, the coupling means 5 instead comprise at least one first threaded socket 13 suitable for being screwed into a corresponding first cavity 14 of the support element 15, 20.

Figure 10:
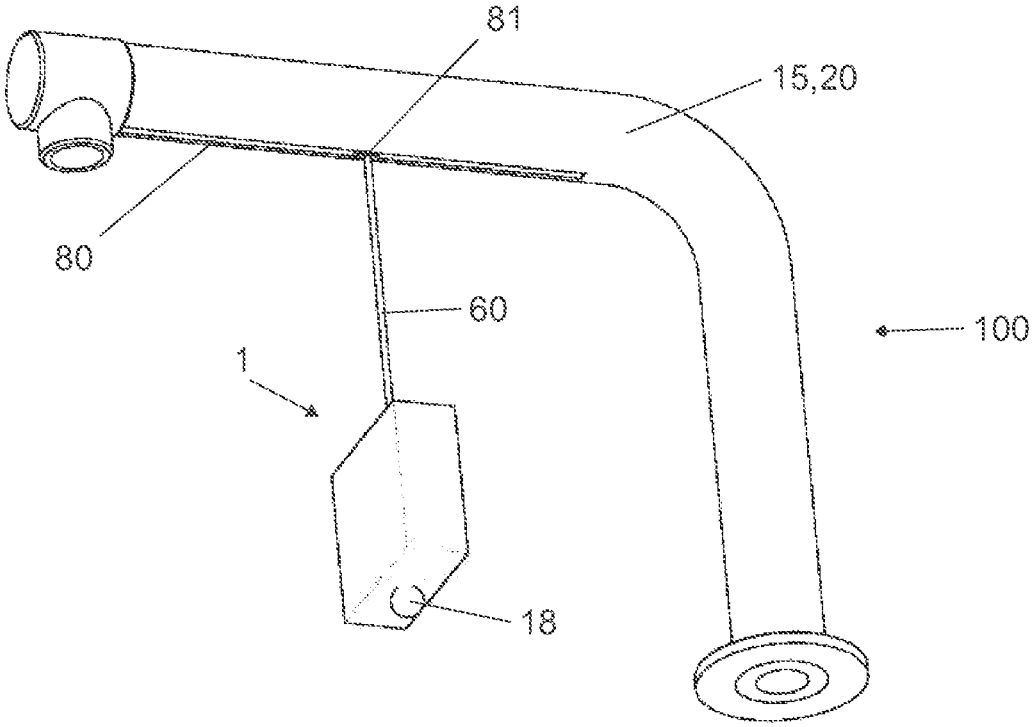
FIG. 10, illustrates in axonometry a soap holder apparatus according to the invention.
Figure 11:
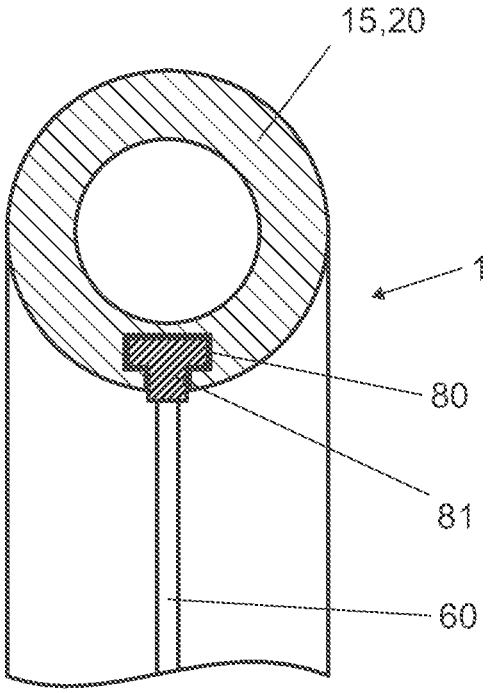
FIG. 11, is section XI-XI shown in FIG. 10.

In the example shown in FIGS. 10 and 11, the attachment means 5 comprise a cavity 80, preferably arranged on the lower surface of the sink, and a slider 81, suitable for sliding within said cavity. Preferably, the elongated body 2 is constrained to said slider. And again, as illustrated in FIGS. 1 to 3, the connection means 7 comprise, in a known manner, at least a second threaded socket 16 apt to be screwed into a corresponding second cavity 17 of the holding elements 18, 18'.

Figure 8:
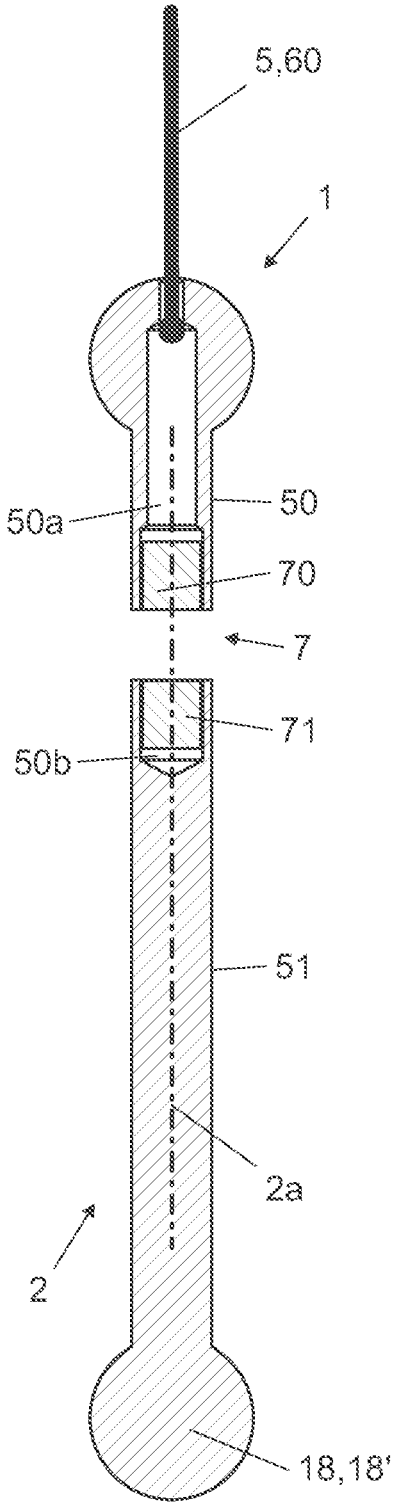
FIG. 8, illustrates an example of a holding element according to the present invention in a first configuration.
Figure 9:
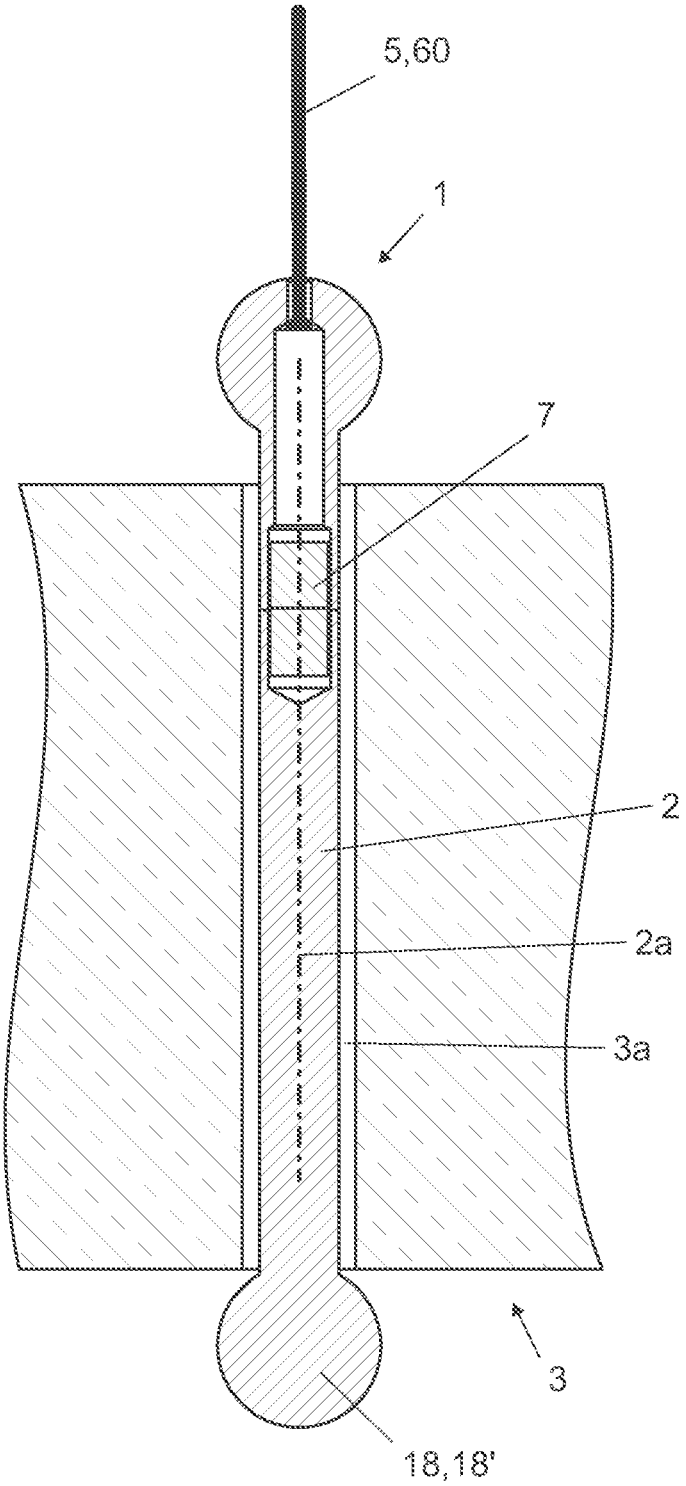
FIG. 9, is the example of FIG. 8 in a second configuration.

Innovatively, as illustrated in FIGS. 8 and 9, the soap holder 1 comprises, preferably, an elongated body 2 comprising an upper portion 50 and a lower portion 51.

The lower portion 51 is, preferably, in one piece with the holding element 18, 18', or integrally constrained thereto.

Furthermore, preferably, the upper portion 50 comprises connection means 7 comprising an upper magnet 70, and the lower portion 51, comprises connection means 7 comprising a lower magnet 71. The two magnets 70 and 71 are preferably capable of being bound to each other, obviously by magnetic attraction.

The upper magnet 70 and the lower magnet 71 are preferably housed within respective cavities 50*a*, 50*b* present in the upper and lower portions 50, 51.

Furthermore, preferably, the upper magnet 70 and the lower magnet 71, when the device 1 is in a spare configuration, are facing outwards from the respective cavities 50*a*, 50*b*.

The outwardly facing portions of the upper and lower magnets 70, 71 are preferably coated with powder coating.

The elongated body 2 is preferably circular in cross-section. It also preferably has an average diameter between 0.5 mm and 1 cm and in particular between 5 mm and 1 cm.

Also, in the example of FIGS. 8 and 9, the attachment means 5 preferably comprise a support cable 60 constrained to the upper portion 50.

In the examples of FIGS. 5-7, and also in the other cases, the first hexagon socket 13 may be replaced by equivalent elements, which perform the functions of the coupling means 5. For example, the coupling means 5 could be replaced by at least one hook (not illustrated) capable of being operatively inserted into a cavity (not illustrated) provided by the support element 15, 20. Or, the attachment means 5 could be at least one magnetic element (not illustrated), also capable of being operatively coupled (in a manner known or within the reach of an average branch technician) to the support element 15, 20.

Figure 4:
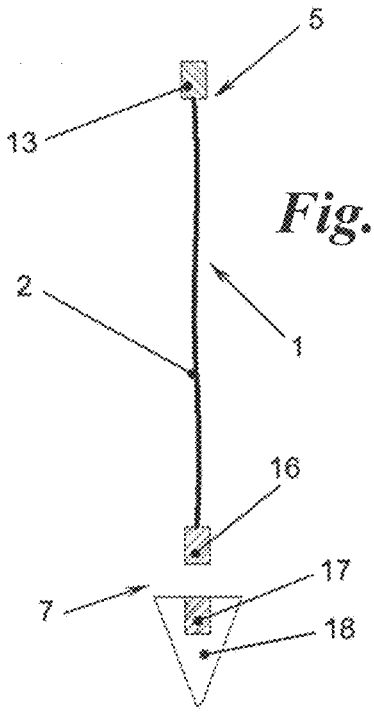
Fig. 4 (Prior Art)
FIG. 4 is a side view of a fourth preferred embodiment of the soap holder according to the prior art.

In the various Figures, two preferred forms of realisation of the holding element 18, 18' are illustrated, namely the spherical shape (FIGS. 1, 3, 5) and the truncated cone shape (FIGS. 2 and 4), but of course the holding element 18 may be realised in cubic, parallelepiped or similar shapes (not illustrated).

With the above configuration, it is therefore possible to connect the soap holder 1 to a tap 15 or a surface or wall, and to use the soap 3 connected to it, before washing. Soiling of the washbasin, sink or other sanitary fixture is also prevented, as the wet soap drips briefly into the drainage basin and then dries in the air, without soiling external walls. Furthermore, soap 3 can be easily replaced, depending on the user's operational or even just aesthetic needs.

In the version with the first socket 13, the conceptual flexibility of the inventive soap holder 1 also allows it to be installed on a tap 15 which has been prepared for this purpose by means of the simple hole 14 in it: here, also, it is easy to screw and unscrew the soap holder 1 should one wish to insert it on the tap 15 or not, and it is just as easy to unscrew the holding element 18 should one wish to replace the soap 3 held by it in the soap holder 1.

In the innovative solution of the two magnets, the use of the soap holder 1 of the present invention will also be open to persons with reduced manual abilities, for example handicapped persons or children, for whom the screwing of the various components in the traditional version would have been difficult to accomplish: in this case, the simple coupling of the soap holder 3 to the soap holder 1 allows the mutual magnetic coupling, in a simple, easy and reproducible manner in any configuration.

It goes without saying that the first lug 13 can be replaced by equivalent elements, which perform the functions of the attachment means 5. For example, the attachment means 5 could be replaced by at least one hook (not illustrated) capable of being operatively inserted into a cavity (not illustrated) provided by the support element 15, 20. Or, the attachment means 5 could be at least one magnetic element (not illustrated), also capable of being operatively coupled (in a manner known or within the reach of an average branch technician) to the support element 15, 20.

With the above configuration, it is therefore possible to connect the flexible soap holder 1 to a tap 15 or a surface or wall, and use the soap 3 connected thereto, before washing, so as to minimise consumption. The contamination of the washbasin, sink or other sanitary fixture is also prevented, as the wet soap briefly drips into the drainage basin and then dries in the air, without soiling external walls. Furthermore, soap 3 can be easily replaced, depending on the user's operational or even just aesthetic needs. In the version with first socket 13, the flexibility of the inventive soap holder 1 also allows it to be installed on a tap 15 prepared for the purpose by means of the simple hole 14 cut in it: here too, it is easy to screw and unscrew the soap holder 1 should one wish to insert it or not on the tap 15, and it is just as easy to unscrew the holding element 25 should one wish to replace the soap 3 supported by it in the soap holder.

The invention claimed is:

1. A soap holder to support a soap bar, having a through-hole, said soap holder comprising:

at least one elongate body having a prevailing extension direction and configured to be inserted said through-hole, the at least one elongate body being a rigid rod;

an attachment system connected to said at least one elongate body and configured to constrain said at least one elongate body to a support element having said prevailing extension direction parallel to said vertical direction;

a holding element configured to support said soap bar preventing said soap bar from sliding away from said at least one elongate body when said at least one elongate body is inserted inside said through-hole; and a connection system configured to releasably constrain said at least one elongate body to said holding element, the connection system comprising permanent magnets, the connection system allowing said soap holder to be arranged:

in a constraining configuration, in which said holding element prevents said soap holder from falling, and in a replacement configuration, in which said holding element does not obstruct the insertion of said at least one elongate body within said through-hole.

2. The soap holder according to claim 1, wherein said at least one elongate body comprises an upper portion and a lower portion, said lower portion being in one piece with said holding element, said upper portion comprising an upper connector comprising an upper magnet, and said lower portion comprising a lower connector comprising a lower magnet.

3. The soap holder according to claim 2, wherein said upper magnet and said lower magnet are housed within respective cavities present in said upper and lower portions.

4. The soap holder according to claim 2, wherein said upper magnet and said lower magnet, when said device is in a spare configuration, are facing outwardly from respective cavities.

5. The soap holder according to claim 4, wherein outwardly facing portions of said upper and lower magnets are coated with powder coating.

6. The soap holder according to claim 1, wherein said at least one elongate body has an average diameter of between 0.5 mm and 1 cm.

7. The soap holder according to claim 2, wherein said attachment system comprises a support cable constrained to said upper portion.

* * * * *